US011230303B2

(12) United States Patent
Bieker et al.

(10) Patent No.: US 11,230,303 B2
(45) Date of Patent: Jan. 25, 2022

(54) RUNNING GEAR FRAME FOR A RAIL VEHICLE

(71) Applicant: Bombardier Transportation GmbH, Berlin (DE)

(72) Inventors: Guido Bieker, Kirchhundem (DE); Adrian Raczko, Hilchenbach (DE); Paul Bottcher, Engelskirchen (DE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 17/058,651

(22) PCT Filed: May 21, 2019

(86) PCT No.: PCT/EP2019/063081

§ 371 (c)(1),
(2) Date: Nov. 24, 2020

(87) PCT Pub. No.: WO2019/224191

PCT Pub. Date: Nov. 28, 2019

(65) Prior Publication Data

US 2021/0197872 A1 Jul. 1, 2021

(30) Foreign Application Priority Data

May 25, 2018 (EP) ..... 18174245

(51) Int. Cl.
*B61F 5/52* (2006.01)

(52) U.S. Cl.
CPC ..... *B61F 5/52* (2013.01)

(58) Field of Classification Search
CPC ..... B61F 5/52
See application file for complete search history.

(56) References Cited

U.S. PATENT DOCUMENTS

| | | | | |
|---|---|---|---|---|
| 5,448,953 | A * | 9/1995 | Bieker | B61D 13/00 105/158.2 |
| 8,196,522 | B2 * | 6/2012 | Bieker | B61F 5/52 105/182.1 |
| 8,504,225 | B2 * | 8/2013 | Bieker | G05B 23/0283 701/19 |
| 8,813,654 | B2 * | 8/2014 | Muller | B61F 5/52 105/172 |
| 9,718,484 | B2 * | 8/2017 | Zanutti | B61F 5/30 |
| 10,259,474 | B2 * | 4/2019 | Bieker | B61F 3/04 |
| 2010/0011985 | A1 * | 1/2010 | Bieker | B61F 5/52 105/206.1 |

(Continued)

FOREIGN PATENT DOCUMENTS

| | | |
|---|---|---|
| CN | 102490754 | 6/2012 |
| CN | 102923152 | 2/2013 |

(Continued)

*Primary Examiner* — Jason C Smith
(74) *Attorney, Agent, or Firm* — Nathan S. Smith; Sujohn Das; Morgan, Lewis & Bockius LLP

(57) ABSTRACT

The present invention relates to a running gear frame for a rail vehicle, in particular, a rail vehicle having a nominal speed above 160 km/h, comprising a running gear frame unit (107) defining a longitudinal axis, a transverse axis and a height axis and comprising two longitudinal beams (108) and at least one transverse beam (110).

20 Claims, 4 Drawing Sheets

(56) References Cited

U.S. PATENT DOCUMENTS

| | | | | |
|---|---|---|---|---|
| 2010/0318246 | A1* | 12/2010 | Bieker | G05B 23/0283 701/19 |
| 2015/0107487 | A1* | 4/2015 | Zanutti | B61F 5/52 105/172 |
| 2015/0144025 | A1* | 5/2015 | Zanutti | B61F 5/305 105/413 |
| 2016/0214628 | A1* | 7/2016 | Bieker | B61F 3/04 |
| 2019/0389493 | A1* | 12/2019 | Gageik | B61F 5/52 |
| 2020/0164902 | A1* | 5/2020 | Bieker | B61F 5/06 |
| 2020/0216101 | A1* | 7/2020 | Dede | B61F 3/16 |

FOREIGN PATENT DOCUMENTS

| | | | |
|---|---|---|---|
| CN | 103465924 | | 12/2013 |
| CN | 203793356 | U | 8/2014 |
| CN | 107406087 | | 11/2017 |
| EP | 2669138 | A1 | 12/2013 |
| FR | 2838698 | A1 | 10/2003 |

* cited by examiner

RUNNING GEAR FRAME FOR A RAIL VEHICLE

This application is the National Stage Entry of PCT/EP2019/063081, filed May 21, 2019, which claims priority from European Patent Application No. 18174245.3, filed May 25, 2018, the entirety of each of which is incorporated herein by reference.

BACKGROUND OF THE INVENTION

The present invention relates to a running gear frame for a rail vehicle, in particular, a rail vehicle having a nominal speed above 160 km/h, comprising a running gear frame unit defining a longitudinal axis, a transverse axis and a height axis and comprising two longitudinal beams and at least one transverse beam. Each of the longitudinal beams extends along the longitudinal axis of the running gear frame unit, while the at least one transverse beam extends along the transverse axis of the running gear frame unit. This transverse beam is substantially rigidly connected to at least one of the longitudinal beams in the area of a joint location. This longitudinal beam, at least in the region of the joint location, has a longitudinal web section extending in a web plane perpendicular to the transverse axis, a web joint part of the transverse beam being connected to the longitudinal web section. The transverse beam, at least in the region of the joint location, is an open structure element such that, in a sectional plane perpendicular to the transverse axis and located at the joint location, the transverse beam has an open, non-ring-shaped profile cross section. The open profile cross section has a first free end and a second free end, wherein a transverse beam inner contour is defined by a connecting line between the first free end and the second free end and an inner circumference of the profile cross section between the first free end and the second free end. The invention further relates to a corresponding running gear comprising such a running gear frame and a rail vehicle comprising such a running gear as well as to a method of manufacturing a corresponding running gear frame.

Such running gear frames are known in the art, for example, from EP 2 669 138 A1 (the entire disclosure of which is incorporated herein by reference). Such open profile transverse beams, compared to conventional closed, generally box-shaped designs (as they are known, for example, from EP 0 685 377 B1), have the advantage that they provide a reduced torsional rigidity of the running gear frame about the transverse axis of the running gear frame. Such a reduced torsional rigidity is beneficial in terms of the running stability and the safety against derailment of the rail vehicle, since the running gear frame itself is able to provide some torsional deformation under uneven wheel loading conditions (e.g. due to track irregularities) and, hence, tends to equalize the wheel to rail contact forces on all four wheels.

As discussed in EP 2 669 138 A1, the properties of the running gear frame as regards its torsional rigidity about the transverse axis can be tuned using parameters such as the shape, the location and/or the dimensions of the respective transverse beam. These parameters, however, may not be freely adapted to a desired torsional rigidity, since they apparently also have an impact on other properties of the running gear frame (e.g. the bending rigidity about the longitudinal axis) which might be adversely affected. Thus, adapting such a running gear frame to a desired torsional rigidity about the transverse axis is a highly complex design task and typically cannot be simply achieved for existing designs.

SUMMARY OF THE INVENTION

Thus, it is the object of the present invention to provide a running gear frame, a running gear, a rail vehicle and a method as described above, which do not show the disadvantages described above, or at least show them to a lesser extent, and, in particular, allow simple and convenient adjustment and reduction, respectively, of the torsional rigidity of such a running gear frame.

The above objects are achieved starting from a running gear frame according to the preamble of claim 1 by the features of the characterizing part of claim 1.

The present invention is based on the technical teaching that simple adjustment, in particular, reduction, of the torsional rigidity of such a running gear frame about the transverse axis may be achieved if the web section of the longitudinal beam, in the region of the joint with the transverse beam, is provided with an aperture of sufficient size to have a noticeable effect on the torsional rigidity of the running gear frame about the transverse axis. The invention has realized that the closed web section of the longitudinal beam, in the region where the transverse beam meets the longitudinal beam, represents a rigidifying component which has a blocking effect counteracting torsion of the open-profile transverse beam and, hence, strongly influences the torsional rigidity of the running gear frame about the transverse axis. By introducing a sufficiently large aperture into the web section at the intersection between the transverse beam and the longitudinal beam it is now possible to reduce this blocking effect.

The amount of reduction of the blocking effect of the web section (and of the torsional rigidity of the running gear frame about the transverse axis) is a function of the size and location of the aperture. The larger the aperture, the lower the blocking effect and the lower the overall torsional rigidity of the running gear frame about the transverse axis. As will be explained in greater detail below with reference to the appended drawings, release of this block (represented by the closed profile of the web section) enables or facilitates a buckling deformation of the adjacent upper and/or lower parts (typically an upper and/or a lower flange) of the longitudinal beam which, as a result, can follow or continue, respectively, more easily the deformation of the transverse beam resulting from the torsional moment about the transverse axis.

Due to the above effect, the size and location of the aperture is a function of the desired reduction in torsional rigidity as well as of the dimensions of the transverse beam at the junction with the longitudinal beam, especially the inner dimensions located adjacent to the aperture. The location of the aperture is selected such that that it at least partially overlaps the projection of the space confined the transverse beam onto the web section.

It will be appreciated that, in particular in case of designs with an upper and/or lower flange section located adjacent to the web section with the aperture, the blocking effect is the lower the smaller the remaining rib (formed by the web section) between the aperture and the upper and/or lower part of the longitudinal beam, since such a rib still counteracts the buckling deformation of the adjacent upper and/or lower part (e.g, the upper and/or lower flange) of the longitudinal beam.

It will be appreciated that the above concept can be applied to any longitudinal beam with at least one such web section at the intersection between the transverse beam and the longitudinal beam. With designs where the longitudinal beam has more than one web section at this intersection (e.g. two or more parallel web sections as a result of a box- or U-shaped design), preferably, the further web section also has a corresponding aperture (typically of the same or at least similar shape and/or size and/or lateral location).

It will be appreciated that the size, shape and location of the aperture is selected such that it has a noticeable effect in terms of allowing the above buckling deformation of the longitudinal beam and releasing the corresponding blocking effect of the web section.

Hence, according to one aspect, the present invention relates to a running gear frame for a rail vehicle, in particular, a rail vehicle having a nominal speed above 160 km/h, comprising a running gear frame unit defining a longitudinal axis, a transverse axis and a height axis and comprising two longitudinal beams and at least one transverse beam. Each of the longitudinal beams extends along the longitudinal axis of the running gear frame unit, while the at least one transverse beam extends along the transverse axis of the running gear frame unit. The at least one transverse beam is substantially rigidly connected to at least one of the longitudinal beams in the area of a joint location. The at least one longitudinal beam, at least in the region of the joint location, has a longitudinal web section extending in a web plane perpendicular to the transverse axis, a web joint part of the transverse beam being connected to the longitudinal web section. The at least one transverse beam, at least in the region of the joint location, is an open structure element such that, in a sectional plane perpendicular to the transverse axis and located at the joint location, the transverse beam has an open, non-ring-shaped profile cross section. The open profile cross section has a first free end and a second free end, wherein a transverse beam inner contour is defined by a connecting line between the first free end and the second free end and an inner circumference of the profile cross section between the first free end and the second free end. The longitudinal web section has an aperture located in the region of a transverse beam projection, wherein the transverse beam projection is a projection of the transverse beam inner contour along the transverse axis onto the web plane, the transverse beam projection confining a transverse beam projection area. The aperture defines an aperture projection, wherein the aperture projection is a projection of the aperture along the transverse axis onto the web plane, an outer contour of the aperture projection confining an aperture projection area. The aperture projection area at least partially overlaps the transverse beam projection area, and the aperture projection area corresponds to at least 60%, preferably at least 75%, more preferably at least 85%, of the transverse beam projection area. With such a configuration an efficient release or reduction of the torsional blocking effect of the web section can be achieved. This reduction can be easily tuned to the desired reduction of the torsional rigidity about the transverse axis by adjusting either of the size, shape and location of the aperture.

It will be appreciated that the size of the aperture can be chosen as large as desired. Limitations are only given by adjacent component, such as the transverse beam, but of course also by the required properties of the longitudinal beam, such as the bending rigidity about the transverse axis. With preferred, particularly useful designs the aperture projection area corresponds to 60% to 150%, preferably to 75% to 120%, more preferably to 85% to 110%, of the transverse beam projection area.

Similar applies to the overlap between the aperture projection area and the transverse beam projection area. With preferred variants at least 40%, preferably, at least 50%, more preferably 40% to 70%, of the aperture projection area overlap with the transverse beam projection area. By this means a particularly beneficial release of the blocking effect of the web section is achieved.

As mentioned, the reduction of the torsional rigidity about the transverse axis can be essentially freely adjusted to the desired value by selecting the size and/or shape and/or location of the aperture accordingly. Preferably, the aperture is arranged and configured such that a torsional rigidity of the running gear frame unit about the transverse axis is reduced by at least 10%, preferably at least 15%, more preferably at least 20%, compared to a reference running gear frame unit lacking the aperture but being of otherwise identical configuration.

With certain preferred variants, suitable area overlap allowing an efficient reduction of the blocking effect and, hence, of the torsional rigidity about the transverse axis, an area center of gravity of the aperture projection is located within the transverse beam projection. In addition or as an alternative, sufficient and suitable area overlap can be achieved if an area center of gravity of the aperture projection has a minimum distance from an outer contour of the transverse beam projection, wherein the minimum distance is less than 20%, preferably less than 10%, more preferably less than 5%, of a maximum dimension of the aperture projection. A suitable overlap can in particular be achieved if an area center of gravity of the aperture projection has a minimum distance from a projection of the connecting line (between the free ends of the transverse beam profile cross section) onto the web plane, wherein the minimum distance is less than 20%, preferably less than 10%, more preferably less than 5%, of a maximum dimension of the aperture projection. By this means an efficient release of the blocking effect of the web section can be achieved, in that the web section's counteraction to the relative motion between the free ends of the profile cross section is reduced.

It will be appreciated that the degree of area overlap between the aperture projection area and the transverse beam projection area can be of any suitable amount to achieve the above desired reduction in torsional rigidity. The degree of area overlap, typically, is a function of the shape of the transverse beam projection area. With preferred variants, the overlap is selected such that the aperture projection area overlaps the respective longest diagonal of the transverse beam projection area taken from the projection of the first free end and of second free end. By overlapping those two longest diagonals, a particularly suitable release of the torsional block formed by the web section can be achieved.

With certain variants, a projection of the connecting line onto the web plane divides the aperture projection into a first aperture projection part and a second aperture projection part or a longest diagonal of the transverse beam projection divides the aperture projection into a first aperture projection part and a second aperture projection part, the longest diagonal, in particular, extending through a projection of one of the free ends. In any of these cases, preferably, an area ratio between the first aperture projection part and the second aperture projection part ranges from 0.6 to 1.5, preferably from 0.8 to 1.2, more preferably from 0.9 to 1.1, in particular, is about 1.0. In addition or as an alternative, the first aperture projection part is fully located within the transverse beam projection. In either case, an efficient release of the blocking effect of the web section can be achieved.

It will be appreciated that the open profile cross section of the transverse beam can have any desired and suitable shape. Preferably, the projection of the first and second free end are spaced by at least 70%, preferably at least 80%, more preferably at least 90%, of the longest dimension of the transverse beam projection. In some cases, the projection of the first and second free end are spaced by essentially 100% of the longest dimension of the transverse beam projection (the projection of the first and second free end then typically also representing this longest dimension of the transverse beam projection).

With certain variants having a particularly simple and easily accessible design of the transverse beam, the open profile cross section is generally L-shaped with a first shank forming the first free end and a second shank forming the second free end. Preferably, the first shank, in the transverse direction, continues into the web joint part, and the second shank, in the transverse direction, continues into a longitudinal flange section of the longitudinal beam. This yields a particularly simple and easy to manufacture design. Particularly suitable release of the torsional block by the web section may then be achieved in cases where the second shank has a shank length along the longitudinal axis and the aperture projection has a minimum shank distance from a projection of the second shank onto the web plane and wherein the minimum shank distance is less than 20%, preferably less than 10%, more preferably less than 5%, of a the shank length. By this means only a comparatively small rib (formed by the web section) is left counteracting the buckling deformation of the longitudinal beam in this region.

With further, robust variants, the open profile cross section is generally U-shaped with a first shank forming the first free end, a base and a second shank forming the second free end, wherein the first and second shank, in particular, may have different lengths. Preferably, in certain variants, the first shank, in the transverse direction, continues into the web joint part, and the base, in the transverse direction, continues into a longitudinal flange section of the longitudinal beam. The second shank, in the transverse direction, may further continue into a further web joint part. Here, preferably, a part of the aperture projection corresponding to the base has a base length along the longitudinal axis and the aperture projection has a minimum base distance from a projection of the base onto the web plane, wherein the minimum base distance is less than 20%, preferably less than 10%, more preferably less than 5%, of a the base length.

With other variants of the U-shaped design, the first shank, in the transverse direction, continues into a longitudinal flange section of the longitudinal beam, and the base, in the transverse direction, continues into the web joint part. In this case, the second shank, in the transverse direction, may continue into a further longitudinal flange section of the longitudinal beam. Here, preferably, one or both of the shanks may have a shank length along the longitudinal axis and the aperture projection has a minimum shank distance from a projection of the respective shank onto the web plane, wherein the respective minimum shank distance is less than 20%, preferably less than 10%, more preferably less than 5%, of a the shank length.

It will be appreciated that the aperture may have any desired and suitable shape and design, respectively. Preferably, the outer contour of the aperture is adapted to the inner contour of the transverse beam projection, typically essentially follows the contour of the transverse beam projection at a certain distance (and within certain distance tolerances). With certain variants, the aperture projection has an outer contour which is at least section-wise curved and/or at least section-wise polygonal. For example, with certain simple variants, the aperture, in the web plane, may have an outer contour which is generally rectangular with (more or less pronouncedly) rounded corners. With other simple design variants, the aperture, in the web plane, may have an outer contour which is generally elliptic, in particular, generally circular.

The longitudinal beam may generally have any desired and suitable design. As mentioned, it may have a closed, generally box shaped design with at least two (typically essentially parallel) web sections. With other particularly simple designs, the longitudinal beam is also designed an open structure with essentially no closed or capsuled spaces. Such designs are particularly favorable in terms of longevity and maintenance, since all structures are readily accessible for (in particular visual) inspection and maintenance. Moreover, such open structures are less susceptible to fouling (or more readily accessible to cleaning, respectively) and subsequent damage (e.g. caused by corrosion).

With certain variants, the longitudinal beam, at least in the region of the joint location, has at least one longitudinal flange section connected to the longitudinal web section. Preferably, the longitudinal flange section mainly extends in a plane substantially perpendicular to the web plane, thereby achieving a particularly simple design. The longitudinal flange section may be an upper flange section of the longitudinal beam, which also yields a particularly simple design, which is beneficial in terms of the load distribution within the longitudinal beam while achieving a lightweight design. In addition or as an alternative, the longitudinal beam, at least in the region of the joint location, may have a further longitudinal flange section connected to the longitudinal web section, wherein the further longitudinal flange section, in particular, may also mainly extend in a plane substantially perpendicular to the web plane. In these cases, the longitudinal beam, in a plane perpendicular to the longitudinal axis, in particular, may have a generally h-shaped or a generally H-shaped cross-section in the region of the joint location. By any of these means, particularly, robust yet lightweight structures well adapted to the load bearing requirements of such a running gear may be achieved.

It will be appreciated that an aperture in the region of the joint location with the respective transverse beam may be sufficient. With certain variants, the web section has at least one further aperture located, in the longitudinal direction, adjacent to the aperture. In addition or as an alternative, the web section, in the longitudinal direction, may have a further aperture located on each side of the aperture. In addition or as an alternative, the web section may have a plurality of apertures arranged in a sequence of apertures along the longitudinal axis, the plurality of apertures, in particular, including the aperture and at least two further apertures. With any of these configurations a particularly lightweight design may be achieved, the adjacent further aperture(s) also contributing to the reduction of the torsional rigidity about the transverse axis by reducing the resistance of the longitudinal beam to the torsion moment related deformation of the longitudinal beam.

It will be appreciated that the longitudinal beam may have any desired and suitable design. In particular, in its longitudinally central part, the longitudinal beam may have a simple L-, T-, H-, or h-shaped cross section. With certain robust yet lightweight designs, the longitudinal beam has one or more transverse web sections, each transverse web section located adjacent to the aperture and mainly extending in a transverse web plane perpendicular to the longitudinal axis. Such an adjacent transverse web section has the advantage that it essentially does not affect the block releasing effect of the aperture but stabilizes the longitudinal beam in other load directions.

With preferred variants, the transverse web section, along the transverse axis, extends up to the region of a lateral end of at least one longitudinal flange section of the longitudinal beam, thereby achieving a favorable increase in the torsional rigidity of the longitudinal beam itself about the longitudinal axis. With preferred variants where the longitudinal beam has an upper and a lower longitudinal flange, the transverse web section, along the transverse axis, preferably extends up to a lateral end of each of the upper longitudinal flange and the lower longitudinal flange of the longitudinal beam.

Particularly favorable results in terms of overall stability yet reduced torsional rigidity about the transverse axis may be achieved if the transverse web section, along the transverse axis, substantially continues the web joint part. Similar applies if two transverse web sections, each located adjacent to the aperture, and at least one longitudinal flange section of the longitudinal beam form a lateral reinforcement cell of the longitudinal beam.

It will be appreciated that, dependent on the desired reduction of the torsional rigidity of the running gear frame about the transverse axis, in principle, one single aperture in the web section of one of the longitudinal beams may be sufficient. Preferably, a similar aperture is provided at the junction of the transverse beam to the other longitudinal beam as well. Moreover, one single transverse beam may be provided connecting the longitudinal beams.

With other variants, however, more than one transverse beam is provided. In these cases, the transverse beam is a first transverse beam, the joint location is a first joint location, and the running gear frame unit comprises a second transverse beam substantially rigidly connected to the longitudinal beam in the region of a second joint location. The second transverse beam may have any desired and suitable design, which may deviate from the first transverse beam. Preferably, however, in the region of the second joint location, a configuration of the second transverse beam is substantially identical to a configuration of the first transverse beam in the region of the first joint location. Similar applies to the configuration of the longitudinal beam in the region of the second joint location. Preferably, in the region of the second joint location, a configuration of the longitudinal beam is substantially identical to a configuration of the longitudinal beam in the region of the first joint location.

The first and second transverse beam may be entirely separate from each other. Preferably, the first transverse beam and the second transverse beam are substantially rigidly connected via at least one transverse beam connector part extending along the longitudinal axis and spaced apart, along the transverse axis, from the longitudinal beams. Such a configuration is particularly beneficial in terms of the torsional resistance of the running gear frame about the height axis.

It will be appreciated that, depending on the required properties of the running gear frame during its operation, any desired generally symmetric or generally asymmetric design may be chosen. With certain variants, the height axis, a center longitudinal plane and a center transverse plane extend through a center point of the running gear frame unit, wherein the center longitudinal plane is perpendicular to the transverse axis, and the center transverse plane is perpendicular to the longitudinal axis. Here, at least the longitudinal beams are substantially symmetric with respect to the center longitudinal plane. In addition or as an alternative, at least the longitudinal beams, in planes perpendicular to the height axis, may be substantially symmetric with respect to the height axis. In addition or as an alternative, at least one of the longitudinal beams may be substantially symmetric with respect to the center transverse plane. In addition or as an alternative, at least the at least one transverse beam may be substantially symmetric with respect to the center longitudinal plane. Finally, in addition or as an alternative, two transverse beams may be provided and at least the two transverse beams are substantially symmetric with respect to the center transverse plane. In any of these cases certain degrees of symmetry are achieved within the running gear frame, which are beneficial in terms of the mechanical properties as well as the manufacture of the running gear frame.

It will be appreciated that the above concepts and principles may be beneficially applied to any type of running gear frame made according to any desired manufacturing technique and of any desired and suitable materials. It may be beneficially implemented with variants made in a differential manufacturing technique, i.e. composed of a plurality of pre-fabricated components connected by a suitable connecting technique (e.g. by welding, clamping, bolting etc.). The above teachings may, in particular, be applied to conventional welded designs made of steel or the like. Moreover, as noted above, the above teachings may, in particular, be applied to existing running gear frame designs to reduce the torsional rigidity about the transverse axis without the necessity to otherwise substantially modify the existing design.

Particularly advantageous is the implementation in the context of cast running gear frame designs where at least a part of the running gear frame is made of a monolithically cast component. In principle any cast materials can be applied, such as e.g. cast steel, cast aluminum etc. Particular advantageous configurations are achieved if the longitudinal beam and the at least one transverse beam, at least in the region of the joint location, are formed by a monolithically cast component made of a grey cast iron material. The grey cast iron material not least has the beneficial effects of being more readily available for automated casting of larger components. Moreover, it has a reduced modulus of elasticity (compared to steel) which also is beneficial in reducing the torsional rigidity about the transverse axis. Here, preferably, the monolithically cast component substantially entirely forms the longitudinal beams and the at least one transverse beam. In principle, any grey cast iron material may be used. Preferably, the grey cast iron material is a spheroidal graphite iron (SGI) cast material. Preferably, the spheroidal graphite iron cast material is one of EN-GJS-450-18, EN-GJS-500-10, EN-GJS-600-10, EN-GJS-400-18U LT and EN-GJS-350-22-LT.

The present invention further relates to a running gear for a rail vehicle, in particular, a high-speed rail vehicle, comprising a running gear frame according to the invention. With such a running gear, the above variants and advantages can be achieved to the same extent, such that reference is made to the explanations given above. Preferably, the running gear frame, in the region of free ends of the longitudinal beams, is supported on two wheel units, in particular, two wheel sets. Furthermore, the present concepts may be used for any type of running gear. Particularly advantageous configurations are achieved, however, if the running gear frame is a running gear frame for a Jacobs-type bogie. It will be further appreciated that the invention can be equally applied in the context of motorized running gears as well as non-motorized running gears.

The present invention further relates to a rail vehicle, in particular, a high-speed rail vehicle, comprising at least one running gear according to the invention. With such a rail vehicle, the above variants and advantages can be achieved to the same extent, such that reference is made to the explanations given above. Preferably, the running gear supports two wagon bodies in the manner of a Jacobs-type bogie.

It should be noted that the present application can be implemented in the context of any type of rail vehicle having any desired nominal speed. In particular, it may be implemented with rail vehicles having nominal speeds even going down to 60 km/h. It may be used for so called light rail vehicles as well as subway or metro vehicles etc. the nominal speeds of which stay below 120 km/h. It may also be applied for commuter or regional trains, typically having nominal speeds between 120 km/h and 180 km/h. As noted, however, it may be particularly beneficially implemented for higher nominal speed vehicles undergoing higher dynamic loads and subject to stricter requirements regarding safety against derailment.

The present invention further relates to a method for manufacturing a running gear frame for a rail vehicle, in particular, a rail vehicle having a nominal speed above 160 km/h, the running gear frame comprising a running gear frame unit defining a longitudinal axis, a transverse axis and a height axis and comprising two longitudinal beams and at least one transverse beam, wherein each of the longitudinal beams extends along the longitudinal axis of the running gear frame unit, and the at least one transverse beam extends along the transverse axis of the running gear frame unit. The method comprises substantially rigidly connecting the at least one transverse beam to at least one of the longitudinal beams in the area of a joint location. The method further comprises forming the at least one longitudinal beam, at least in the region of the joint location, such that it has a longitudinal web section extending in a web plane perpendicular to the transverse axis, a web joint part of the transverse beam being connected to the longitudinal web section. The method further comprises forming the at least one transverse beam such that, at least in the region of the joint location, it is an open structure element such that, in a sectional plane perpendicular to the transverse axis and located at the joint location, the transverse beam having an open, non-ring-shaped profile cross section, wherein the open profile cross section has a first free end and a second free end, wherein a transverse beam inner contour is defined by a connecting line between the first free end and the second free end and an inner circumference of the profile cross section between the first free end and the second free end.

The method further comprises that the longitudinal web section is provided with an aperture located in the region of a transverse beam projection, wherein the transverse beam projection is a projection of the transverse beam inner contour along the transverse axis onto the web plane, the transverse beam projection confining a transverse beam projection area. The aperture defines an aperture projection, wherein the aperture projection is a projection of the aperture along the transverse axis onto the web plane, an outer contour of the aperture projection confining an aperture projection area. The aperture projection area at least partially overlaps the transverse beam projection area, and the aperture projection area corresponds to at least 60%, preferably at least 75%, more preferably at least 85%, of the transverse beam projection area. With such a method as well, the above variants and advantages can be achieved to the same extent, such that reference is made to the explanations given above.

The invention is explained in greater detail below with reference to embodiments as shown in the appended Figures.

DETAILED DESCRIPTION OF THE INVENTION

First Embodiment

With reference to FIGS. 1 to 6 a preferred embodiment of a rail vehicle 101 according to the present invention comprising a preferred embodiment of a running gear 102 according to present the invention with a preferred embodiment of a running gear frame 103 according to the present invention will now be described in greater detail.

In order to simplify the explanations given below, an xyz-coordinate system has been introduced into the Figures, wherein (on a straight, level track T) the x-axis designates the longitudinal axis (or direction, respectively) of the rail vehicle 101, the y-axis designates the transverse axis (or direction, respectively) of the rail vehicle 101 and the z-axis designates the height axis (or direction, respectively) of the rail vehicle 101 (the same, of course, applies for the running gear 102 and the running gear frame 103). It will be appreciated that all statements made in the following with respect to the position and orientation of components of the rail vehicle, unless otherwise stated, refer to a static situation with the rail vehicle 101 standing on a straight level track under nominal loading.

Figure 1:
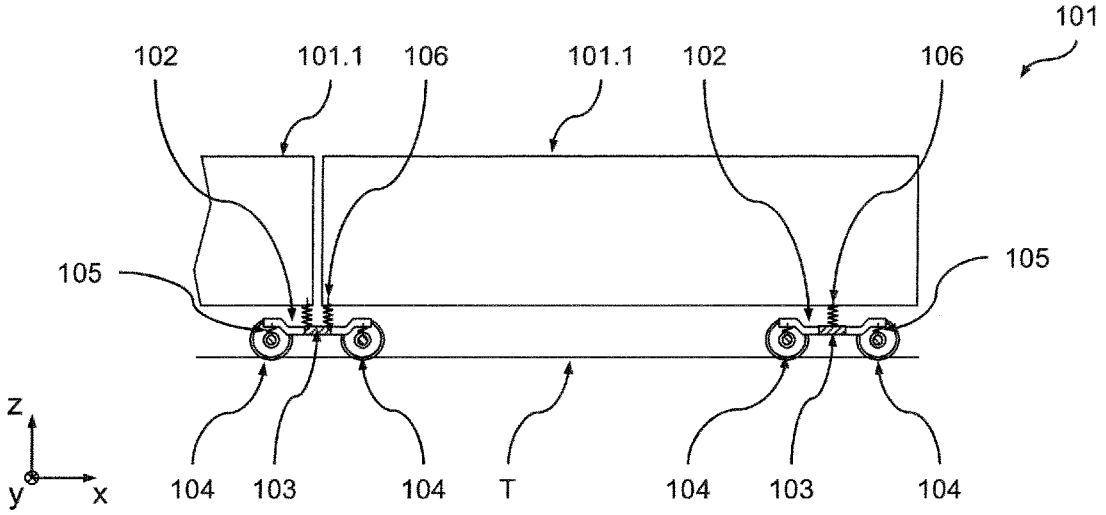
FIG. 1 is a schematic partially sectional side view of a preferred embodiment of a rail vehicle according the invention having a preferred embodiment of a running gear according the invention with a preferred embodiment of a running gear frame according the invention manufactured using a preferred embodiment of a method according the invention.

The vehicle 101 is a rail vehicle with a nominal speed above 160 km/h, in particular a high speed rail vehicle with a nominal speed above 220 km/h. The vehicle 101 comprises two wagon bodies 101.1 supported by a suspension system on running gears 102 (see FIG. 1). One of the running gears 102 is a Jacobs-type bogie supporting both wagon bodies 101.1 at their adjacent ends. Each running gear 102 comprises two wheel units in the form of wheel sets 104 supporting the running gear frame 103 via a primary spring unit 105. The running gear frame 104 supports the wagon body via a secondary spring unit 106. Each of the two running gears 102 shown in FIG. 1 is implementing the present invention. While in the following reference is made mainly to the Jacobs-type bogie 102 of FIG. 1, it will be appreciated that these explanations also apply to the other bogie 102 shown in FIG. 1.

Figure 2:
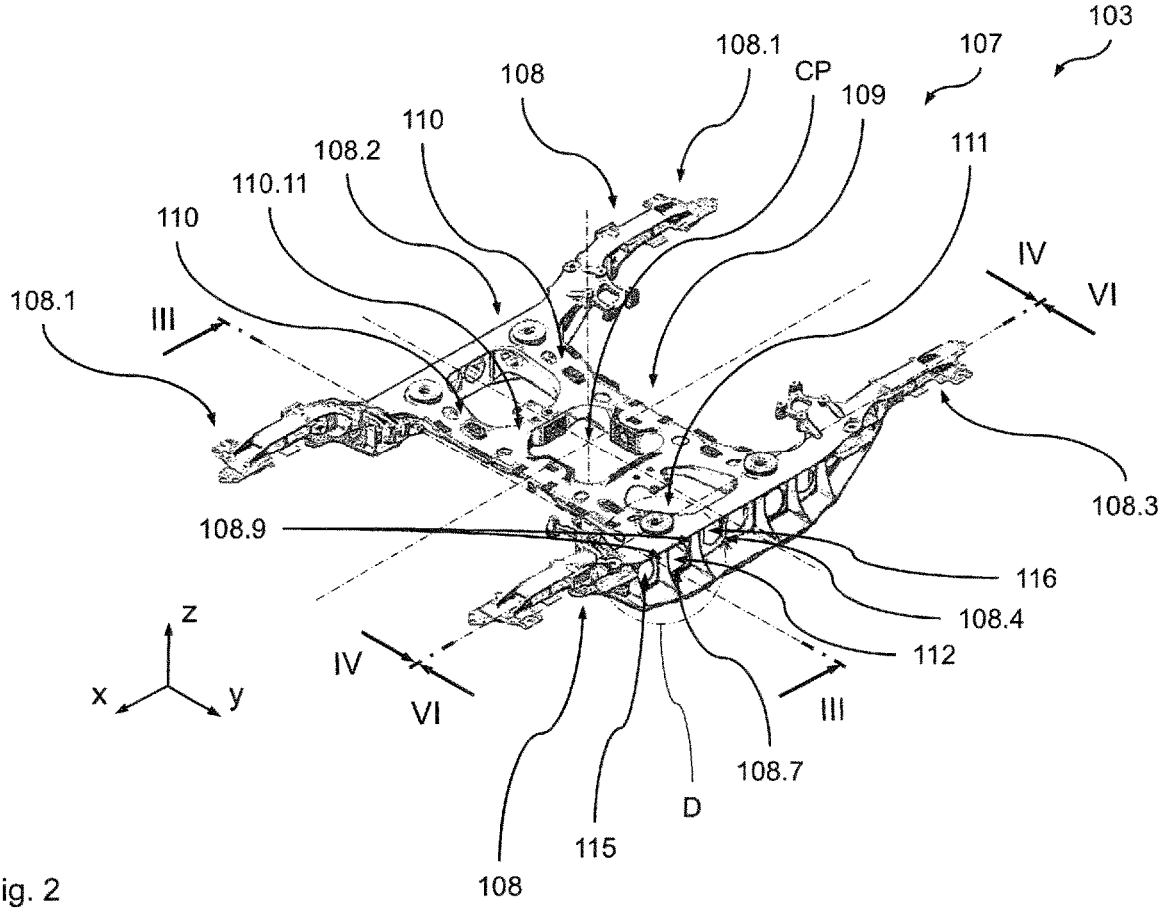
FIG. 2 is a perspective view of the running gear frame of FIG. 1.

As can be seen from FIG. 2, showing the running gear frame 103 of the Jacobs-type bogie 102 of FIG. 1, the running gear frame 103 has a running gear frame unit 107 which comprises two longitudinal beams 108 extending along the longitudinal axis (x-axis) and a transverse beam unit 109 extending along the in the transverse axis (y-axis) and providing a substantially rigid structural connection between the longitudinal beams 108 such that a substantially H-shaped frame configuration is formed.

Each longitudinal beam 108 has two free end sections 108.1 and a central section 108.2. The central section 108.2 is connected to the transverse beam unit 109 while the free end sections 108.1 form a primary suspension interface 108.3 for a respective primary suspension device (not shown in greater detail) of the primary suspension unit 105 connected to the associated wheel unit 103. In the present example, a compact and robust rubber-metal-spring is used for the primary spring device of the primary suspension 105. However, with other variants, any other suitable primary spring device may be used.

The transverse beam unit 109 comprises two transverse beams 110, each of which, at both of its ends, is substantially rigidly connected to the longitudinal beams 108 in the area of a joint location 111. It will be appreciated that the design of the frame unit 107 at the respective joint location 111 may be different for one or more (up to all) of the joint locations 111, in the present variant, the design of all four joint locations 111 is substantially identical, such that the following explanations are given by way of example for one of the joint locations only.

As will be explained in the following with reference to FIGS. 2 to 6, the longitudinal beam 108 has a longitudinal web section 108.4, which extends along its entire central section 108.2 up into the end sections 108.1. Hence, the web section 108.4 is also present in the region of the joint location 111. The longitudinal web section 108.4 extends in a web plane WP (see FIG. 3) which itself is perpendicular to the transverse axis (y-axis).

Figure 3:
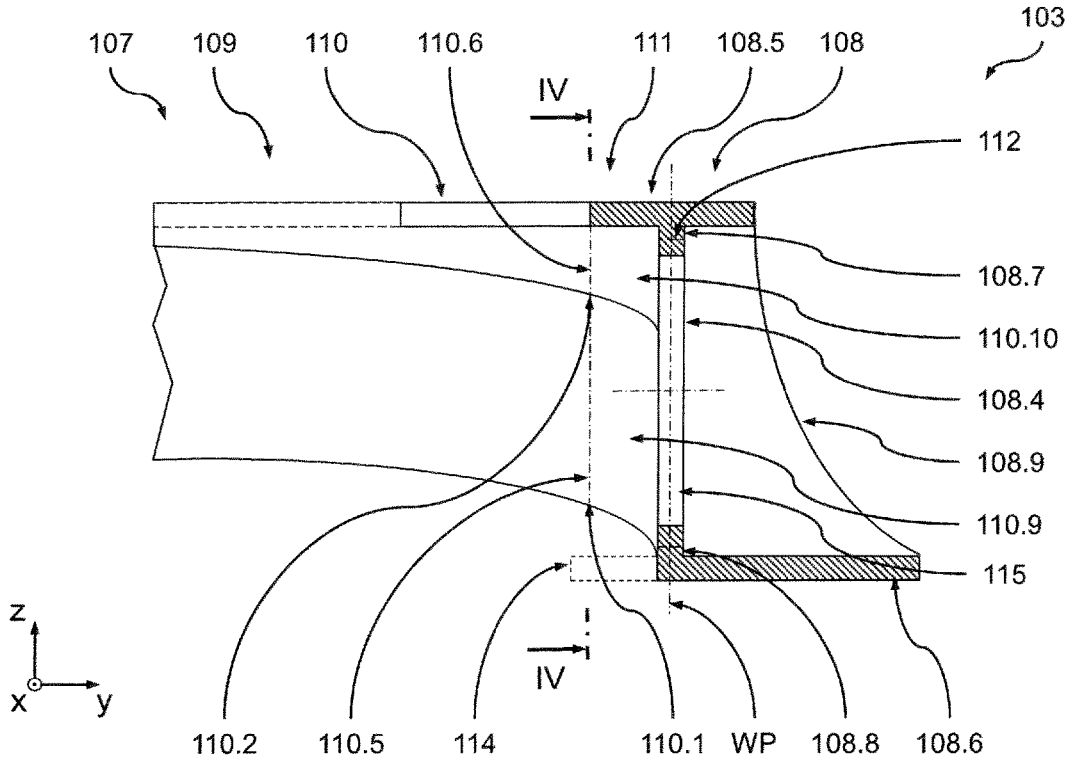
FIG. 3 is a sectional view of detail D of the running gear frame of FIG. 2 along line III-III of FIG. 2.
Figure 4:
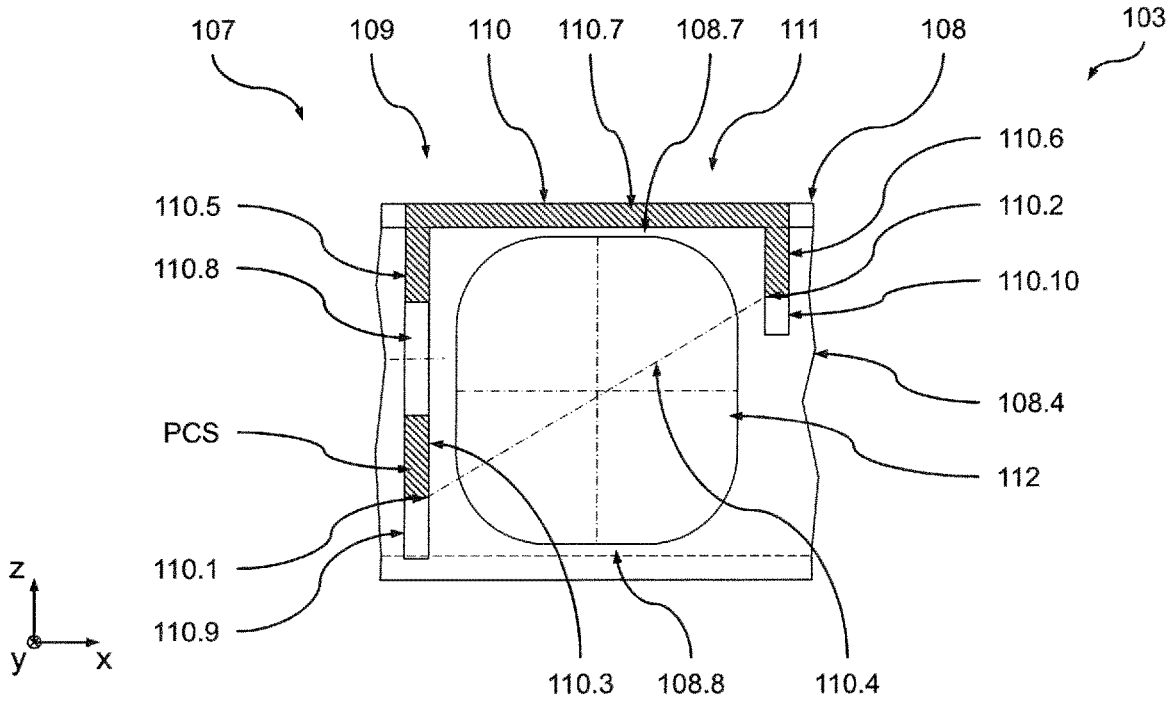
FIG. 4 is a sectional view of detail D of the running gear frame of FIG. 2 along line IV-IV of FIGS. 2 and 3.

As can be seen, in particular, from FIGS. 2 to 4, the transverse beam 110, is a generally U-shaped open structure element. Hence, also in the region of the joint location 111, in a sectional plane SPJL perpendicular to the transverse axis and located at the joint location 111 as shown in FIG. 4 (see also line IV-IV in FIG. 2), the transverse beam 110 has an open, non-ring-shaped profile cross section 110.1.

The open profile cross section PCS has a first free end 110.1 and a second free end 110.2, wherein a transverse beam inner contour 110.3 is defined by a connecting line 110.4 between the first free end 110.1 and the second free end 110.2 and an inner circumference of the profile cross section PCS of the transverse beam 110 between the first free end 110.1 and the second free end 110.2.

As can be particularly well seen from FIG. 4, the open profile cross section PCS is generally U-shaped with a first shank 110.5 forming the first free end 110.1, a second shank 110.6 forming the second free end 110.2, and a base 110.7, connecting the first and second shanks 110.5, 110.6. The first and second shanks 110.5, 110.6 have different lengths. Moreover, the first shank 110.5, in the region of the joint location 111, has an opening 110.8. One or more such openings 110.8 may be present in the transverse beam 110 (e.g. for functional reasons and/or for weight reduction reasons). It will be appreciated that, for the purpose of the present application, such openings 110.8 are neglected (considered filled or not present) when defining the transverse beam inner contour 110.3.

In the present example, the first shank 110.5, in the transverse direction (i.e. along the transverse axis), continues into a web joint part 110.9 of the transverse beam 110, which is connected to the longitudinal web section 108.4. The base 110.7, in the transverse direction, continues into an upper longitudinal flange section 108.5 of the longitudinal beam 108. The second shank 110.6, in the transverse direction, continues into a further web joint part 110.10, again connected to the longitudinal web section 108.4. Both web joint parts 110.9, 110.10 of the transverse beam 110, along the height axis, end before the lower side of the longitudinal beam 108 formed by a lower longitudinal flange section 108.6 of the longitudinal beam 108.

Figure 5:
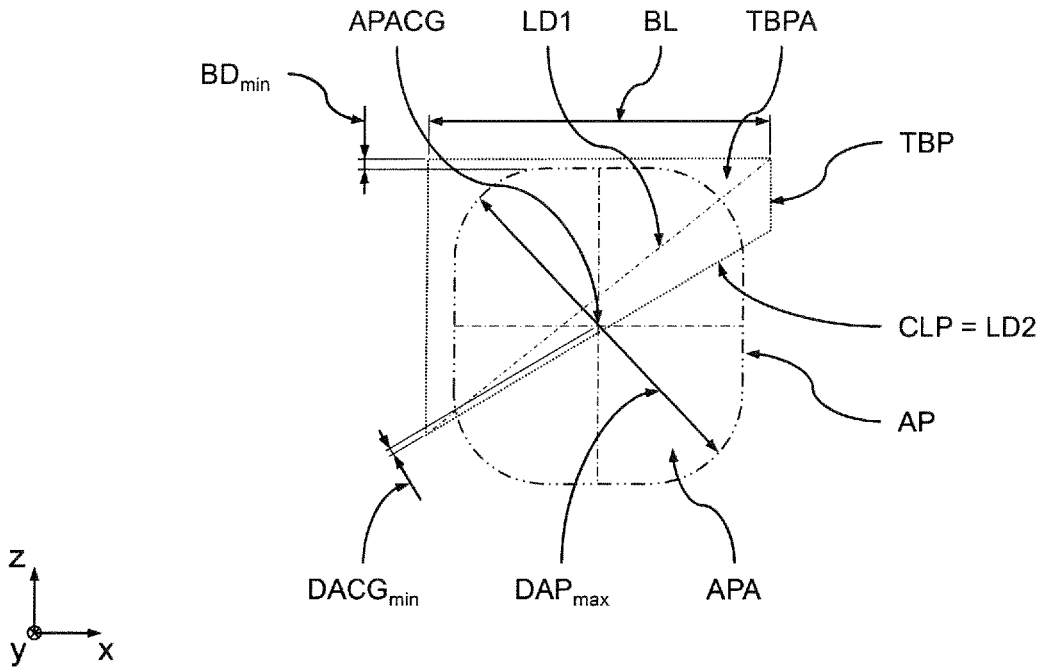
FIG. 5 is an isolated representation of the aperture and transverse beam projections onto the web plane of FIG. 4.

The longitudinal web section 108.4 has an aperture 112 located in the region of a transverse beam projection TBP (see, in particular, FIG. 5), wherein the transverse beam projection TBP is a projection of the transverse beam inner contour 110.3 along the transverse axis onto the web plane WP (which is the drawing plane of FIG. 5). The transverse beam projection TBP confines a transverse beam projection area TBPA. The aperture 112 defines an aperture projection AP, wherein the aperture projection AP is a projection of the aperture 112 along the transverse axis onto the web plane WP, wherein an outer contour of the aperture projection AP confines an aperture projection area APA.

As can be seen from FIG. 4 and particularly well from FIG. 5, the aperture projection area APA partially overlaps the transverse beam projection area TBPA. By this means, i.e. with this aperture 112 in the longitudinal web section 108.4 a simple reduction of the torsional rigidity TRT of the running gear frame 103 about the transverse axis may be achieved. As explained above, it has been realized that a closed web section of the longitudinal beam, i.e. a web section missing aperture 112 in the region where the transverse beam 110 meets the longitudinal beam 108, represents a rigidifying component which has a blocking effect counteracting torsion of the open-profile transverse beam 110 and, hence, strongly influences the torsional rigidity TRT of the running gear frame 103 about the transverse axis. By introducing a sufficiently large aperture 112 into the web section 108.4 at this intersection as it is done in the present example, it is now possible to reduce this blocking effect.

As explained above, the amount of reduction of the blocking effect of the web section 108.4 (and of the torsional rigidity TRT of the running gear frame 103 about the transverse axis) is a function of the size and location of the aperture 112. The larger the aperture 112, the lower the blocking effect and the lower the overall torsional rigidity TRT of the running gear frame 103 about the transverse axis.

Figure 6:
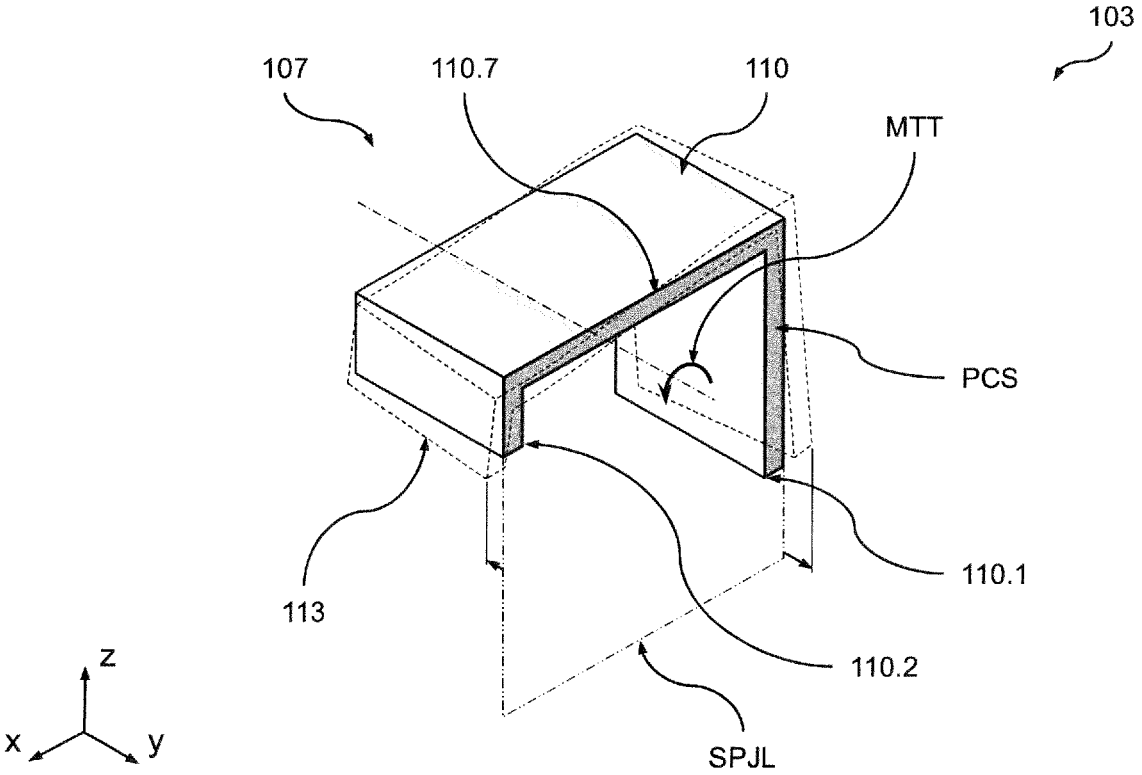
FIG. 6 is schematic perspective and sectional view of detail D of FIG. 2 along line VI-VI of FIG. 2.

As will be explained in the following with reference to FIG. 6, release of this block (which would be represented by a web section 108.4 lacking aperture 112) enables or facilitates a buckling deformation of the adjacent upper and lower flanges 108.5 and 108.6 of the longitudinal beam 108. FIG. 6 shows a schematic perspective view of a part of the transverse beam 110 located laterally i.e. along the transverse axis) inward of the profile cross section PCS in the sectional plane SPJL of the joint location 111.

As can be seen from FIG. 6, under the influence of a torsional moment MTT acting on the transverse beam 110 about the transverse axis, the open profile transverse beam 110 tends to deform as it is indicated by the dashed line 113. More precisely, the first end 110.1 of the profile cross section PCS is pushed laterally outwards (with respect to plane SPJL), while the second end 110.1 of the profile cross section PCS is pulled laterally inwards (with respect to plane SPJL). At the same time, the base 110.7 undergoes a buckling deformation which results in a generally S-shaped base 110.7.

In a conventional design without aperture 112, the deformation as represented by contour 113 would be blocked by the closed longitudinal web section. However, as a result of the aperture 112 in the web section 108.4, the longitudinal beam 108, especially the upper and lower flanges 108.5 and 108.6 can now more easily follow or continue, respectively, more the deformation of the transverse beam 110, especially the buckling of the base 110.7, resulting from the torsional moment MTT about the transverse axis.

It will be appreciated that, in the present example, the residual blocking effect of the remaining web section 108.4 at the circumference of the aperture 112 is the lower the smaller the remaining rib 108.7 (formed by the web section 108.4) between the aperture 112 and the upper and/or lower flange 108.5 and 108.6 of the longitudinal beam 108, since such a rib 108.7 still to a certain extent counteracts the buckling deformation of the adjacent flange 108.5 and 108.6, respectively.

It will be appreciated that, depending on the desired reduction of the torsional rigidity TRT of the running gear frame 103, the size, shape and location of the aperture 112 is selected such that it has a corresponding noticeable effect in terms of allowing the above buckling deformation of the longitudinal beam 108 and releasing the corresponding blocking effect of the web section 108.4. In the present example, the aperture projection area APA corresponds to about 130% of the transverse beam projection area TBPA. It will be appreciated, however, that with other variants, the aperture projection area APA may correspond to at least 60%, preferably at least 75%, more preferably at least 85%, of the transverse beam projection area.

It will be appreciated that the size of the aperture 112, in principle, can be chosen as large as desired and possible. Limitations are only given by adjacent components, such as the transverse beam 110, but of course also by the required properties of the longitudinal beam 108, such as the bending rigidity of the longitudinal beam 108 about the transverse axis. With preferred, particularly useful designs the aperture projection area APA corresponds to 60% to 150%, preferably to 75% to 120%, more preferably to 85% to 110%, of the transverse beam projection area TBPA.

Similar applies to the overlap between the aperture projection area APA and the transverse beam projection area TBPA. In the present example, slightly more than 50% of the aperture projection area APA overlap with the transverse beam projection area TBPA. It will be appreciated that, with other embodiments, another degree of overlap may be selected. In particular, with other preferred variants, at least 40%, preferably, at least 50%, more preferably 40% to 70%, of the aperture projection area APA overlap with the transverse beam projection area TBPA. By this means a particularly beneficial release of the blocking effect of the web section is achieved.

As mentioned above, the reduction of the torsional rigidity TRT of the running gear frame 103 about the transverse axis can be essentially freely adjusted to the desired value by selecting the size and/or shape and/or location of the aperture 112 accordingly. In the present example, with the four apertures 112 at the junctions between the longitudinal beams 108 and the transverse beams 110, compared to an otherwise identical design without those apertures 112, an overall reduction of the torsional rigidity TRT by about 60% to 80% may be achieved. With other preferred variants, the aperture is arranged and configured such that a torsional rigidity TRT of the running gear frame unit 107 about the transverse axis is reduced by at least 10%, preferably at least 15%, more preferably at least 20%, compared to a reference running gear frame unit lacking the aperture 112 but being of otherwise identical configuration.

The present example, suitable area overlap allowing an efficient reduction of the blocking effect and, hence, of the torsional rigidity TRT is achieved in that an area center of gravity APACG of the aperture projection APA is located within the transverse beam projection TBP. In the present example, suitable area overlap is achieved, in particular, in that the area center of gravity APACG of the aperture projection APA has a minimum distance $DACG_{min}$ from an outer contour of the transverse beam projection TBP, which is about 2% to 5% of a maximum dimension $DAP_{max}$ of the aperture projection AP. With other preferred variants, the minimum distance $DACG_{min}$ is less than 20%, preferably less than 10%, more preferably less than 5%, of a maximum dimension $DAP_{max}$ of the aperture projection AP.

Typically, as in the present example, the minimum distance $DACG_{min}$ is present with respect to the projection CLP of the connecting line 110.4. Hence, similarly, with other variants the area center of gravity APACG of the aperture projection APA may have a minimum distance from a projection PCL of the connecting line 110.4 (between the free ends 110.1, 110.2 of the transverse beam profile cross section PCS) onto the web plane WP, which is less than 20%, preferably less than 10%, more preferably less than 5%, of the maximum dimension $DAP_{max}$ of the aperture projection AP.

It will be appreciated that the degree of area overlap between the aperture projection area APA and the transverse beam projection area TBPA can be of any suitable amount to achieve the above desired reduction in torsional rigidity TRT of the running gear frame unit 107 and the running gear frame 103, respectively. The degree of area overlap, typically, is a function of the shape of the transverse beam projection TBP. With preferred variants, as in the present example, the overlap is selected such that the aperture projection area APA overlaps the respective longest diagonal LD1, LD2 of the transverse beam projection area TBPA taken from the projection of the first free end 110.1 and of second free end 110.2. By overlapping those two longest diagonals LD1, LD2, a particularly suitable release of the torsional block formed by the web section can be achieved.

In the present example, the projection of the connecting line CLP onto the web plane WP divides the aperture projection AP into a first aperture projection part APP1 and a second aperture projection part APP2, wherein the first aperture projection part APP1 is fully located within the transverse beam projection TBP. The arrangement is such that an area ratio between the first aperture projection part APP1 and the second aperture projection part APP2 it is about 52% by 48%, i.e. about 1.1. With other variants, this area ratio may preferably range from 0.6 to 1.5, preferably from 0.8 to 1.2, more preferably from 0.9 to 1.1. In many cases it is preferred that the area ratio is about 1.0. By these means, efficient release of the blocking effect of the web section 108.4 can be achieved.

It will be appreciated that, with other variants, depending on the shape of the aperture projection AP and the transverse beam projection TBP, instead of the projection of the connecting line CLP, a longest diagonal LD of the transverse beam projection TBP may divide the aperture projection into the first aperture projection part APP1 and a second aperture projection part APP2. In these cases, the above area ratios are similarly preferred.

Here, preferably, the part of the aperture projection AP corresponding to the base 110.7 has a base length BL along the longitudinal axis and the aperture projection has a minimum base distance $BD_{min}$ from a projection of the base 110.7 onto the web plane WP, wherein the minimum base distance $BD_{min}$ is about 3% to 5%. By this means, the rib 108.7 formed by the remaining part of the web section 108.4 is kept sufficiently small in order to keep its blocking effect against buckling of the upper flange 108.5 and, consequently, against torsion of the running gear frame 103 about the transverse axis sufficiently low. For the same reasons, a similarly small rib 108.8 is formed in the area of the lower flange 108.6 of the longitudinal beam 108. With other preferred variants, the minimum base distance $BD_{min}$ may be less than 20%, preferably less than 10%, more preferably less than 5%, of the base length.

It will be appreciated that the open profile cross section PCS of the transverse beam 110 can have any desired and suitable shape. In the present case, to have a sufficiently open profile of the transverse beam 110 itself yielding sufficiently low torsional rigidity about the transverse axis, the first and second free ends 110.1, 110.2 are spaced by 90% of the longest dimension (here diagonal LD1) of the transverse beam projection TBP. To achieve this goal, with other variants, the projection of the first and second free end 110.1, 110.2 are preferably spaced by at least 70%, preferably at least 80%, more preferably at least 90%, of the respective longest dimension of the transverse beam projection TBP.

The present example, the aperture 112 is adapted to the inner contour of the transverse beam projection TBP in that it essentially follows the contour of the transverse beam projection TBP at a certain distance (and within certain distance tolerances). To this end, the aperture projection AP has an outer contour which is a sequence of curved and straight parts yielding a generally rectangular shape with pronouncedly rounded corners. With other embodiments, however, the aperture 112 may also be polygonal, elliptic or circular, etc.

As already described above, the longitudinal beam 108 has a particularly favorable design in that it is also designed an open structure with essentially no closed or capsuled spaces. Such a design is particularly favorable in terms of longevity and maintenance, since all structures of the longitudinal beam 108 are readily accessible for (typically simple visual) inspection and maintenance. Moreover, such open structures are less susceptible to fouling (or more readily accessible to cleaning, respectively) and subsequent damage (e.g. caused by corrosion).

As can be seen particularly well from FIG. 3, the longitudinal beam the two longitudinal flange sections 108.5 and 108.6 mainly extend in a plane substantially perpendicular to the web plane WP. The lower flange 108.6 only protrudes laterally outward from the web section 108.4 such that a simple generally h-shaped design is achieved. Such a design is beneficial in terms of the load distribution within the longitudinal beam 108 while being lightweight at the same time. Hence, a particularly robust yet lightweight structure well adapted to the load bearing requirements of such a running gear frame 103 is achieved. It will be appreciated that, with other embodiments, a design with a generally H-shaped cross-section of the longitudinal beam 108 might be chosen as it is indicated by the dashed contour 114 in FIG. 3.

As noted above, an aperture 112 in the region of the joint location 111 with the respective transverse beam 110 may be sufficient to achieve the desired reduction in the torsional rigidity TRT of the running gear frame 103 about the transverse axis. In the present example, however, the web section 108.4 has further apertures 115 and 116 (see FIG. 2) located adjacent, in the longitudinal direction, on both sides of each aperture 112. Hence, the web section 108.4 is provided with a plurality of apertures 112, 115, 116 arranged in a sequence of apertures along the longitudinal axis. By this means, a particularly lightweight design is achieved, wherein the adjacent further apertures 115, 116 also contribute to the reduction of the torsional rigidity TRT of the running gear frame 103 about the transverse axis by further reducing the resistance of the longitudinal beam 108 to the deformation of the longitudinal beam 108 related to the torsion moment MTT.

As can be seen from FIGS. 2 and 3, a robust yet lightweight design of the longitudinal beam is achieved in that the longitudinal beam has two transverse web sections 108.9, one on each (longitudinal) side of the aperture 112. Each transverse web section 108.9 mainly extends in a transverse web plane perpendicular to the longitudinal axis. These adjacent transverse web sections 108.9 have the advantage that the essentially do not affect the block releasing effect of the aperture 112 but each stabilize the longitudinal beam in other load directions.

As can be seen from FIG. 1 and, in particular, from FIG. 3, the transverse web sections 108.9, along the transverse axis, extend up to the region of a lateral end of the upper and lower longitudinal flange section 108.5 and 108.6, respectively, of the longitudinal beam 108. By this means, a favorable increase in the torsional rigidity TRL of the longitudinal beam 108 about the longitudinal axis is achieved.

A particularly favorable result in terms of overall stability yet reduced torsional rigidity TRT about the transverse axis is achieved in that the respective transverse web section 108.9, along the transverse axis, substantially continues the associated web joint part 110.9 and 110.10 of the transverse beam 110. In essence, the two transverse web sections 108.9, and the two longitudinal flange sections 108.5 and 108.6 of the longitudinal beam 108 form a lateral reinforcement cell of the longitudinal beam 108.

As can be seen from FIG. 2, the two transverse beams 108 are of essentially identical configuration, wherein their longer shanks 110.5 face each other and are located close to the center transverse plane (extending through a center point CP of the running gear frame unit 107 and perpendicular to the longitudinal axis). Such a configuration has the advantage that, despite providing sufficiently high bending rigidity BRL of the running gear frame 103 about the longitudinal axis, their contribution to the torsional rigidity TRT of the running gear frame 103 about the transverse axis it is kept sufficiently low.

Moreover, transverse beams 110 are substantially rigidly connected via two transverse beam connector parts 110.11 extending along the longitudinal axis and spaced apart, along the transverse axis, from the longitudinal beams 108. In the present example, each transverse beam connector part 110.11 is spaced from the associated longitudinal beam 108 by about one third of the distance between the two longitudinal beams 108 in the transverse direction. Such a configuration is particularly beneficial in terms of the torsional resistance or torsional rigidity TRH of the running gear frame 103 about the height axis.

In the present example, the longitudinal beams 108 are substantially symmetric with respect to the center longitudinal plane (extending through the center point CP of the running gear frame unit 107 and perpendicular to the transverse axis) and the center transverse plane. The transverse beams 108 are substantially symmetric with respect to the center longitudinal plane. It will be appreciated, however, that depending on the required properties of the running gear frame 103 during its operation, any desired generally symmetric or generally asymmetric design may be chosen as well.

The present example, a particularly advantageous configuration is achieved in that the running gear frame unit 107 is made of a single monolithically cast component. While, in principle, any cast materials can be applied, in the present example, a grey cast iron material is used. The grey cast iron material not least has the beneficial effects of being more readily available for automated casting of larger components. Moreover, it has a reduced modulus of elasticity (compared to steel) which also is beneficial in reducing the torsional rigidity TRT of the running gear frame unit 107 about the transverse axis. In principle, any grey cast iron material may be used. Preferably, the grey cast iron material is a spheroidal graphite iron (SGI) cast material. Preferably, the spheroidal graphite iron cast material is one of EN-GJS-450-18, EN-GJS-500-10, EN-GJS-600-10, EN-GJS-400-18U LT and EN-GJS-350-22-LT.

It will be appreciated, however, that the above concepts and principles may be beneficially applied to any other type of running gear frame 103 made according to any desired manufacturing technique and of any desired and suitable materials. In particular, it may be beneficially implemented with variants made in a differential manufacturing technique, i.e. composed of a plurality of pre-fabricated components connected by a suitable connecting technique (e.g. by welding, clamping, bolting etc.). In particular, the above principles may be applied to conventional welded running gear frames 103 made of steel or the like. Moreover, as previously noted, the above teachings may, in particular, be applied to existing running gear frame designs to reduce their torsional rigidity TRT about the transverse axis without the necessity to otherwise substantially modify the existing design.

Second Embodiment

Figure 7:
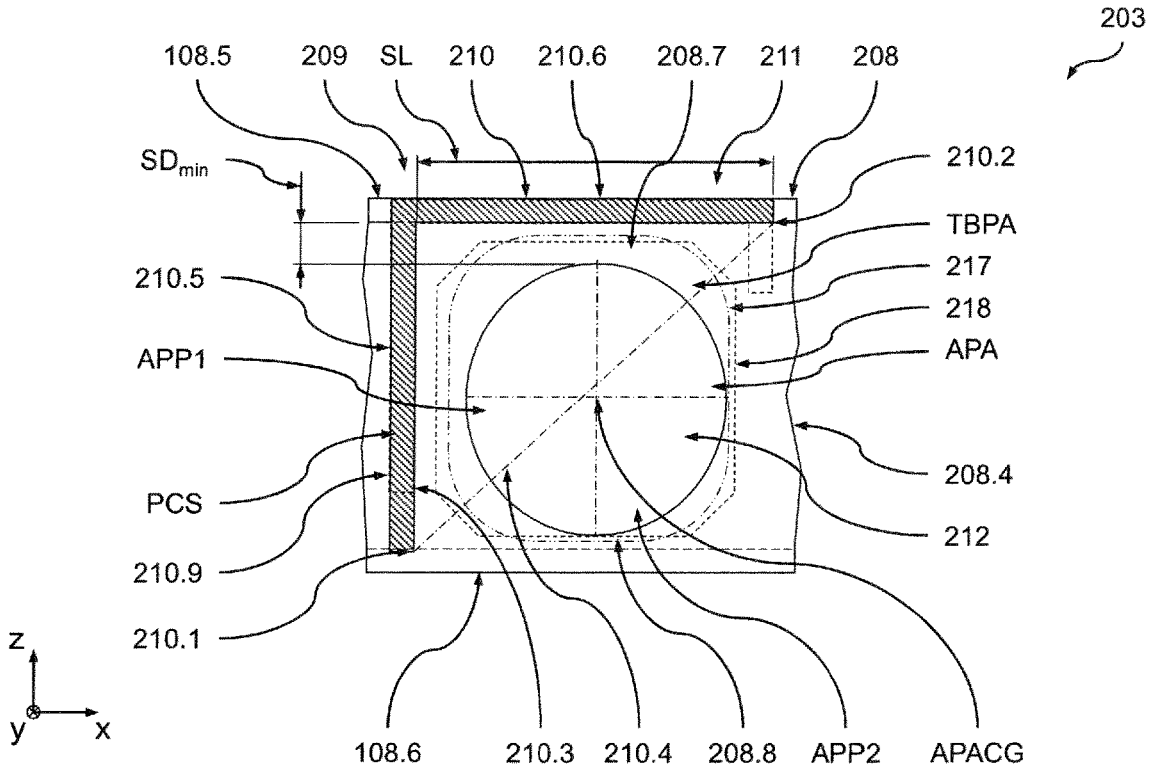
FIG. 7 is a sectional view of a detail of a further preferred embodiment of the running gear frame according to the invention in a view similar to FIG. 3.

In the following, a further preferred embodiment of a running gear frame 203 according to the invention will be described with reference to FIGS. 1, 2 and 7. The running gear frame 203 in in its basic design and functionality corresponds to the running gear frame 103 of the first embodiment and may replace the running gear frame 103 in the rail vehicle of FIG. 1. While identical components are given the same reference, like components are given a reference increased by the value 100. Unless stated otherwise in the following, as regards the properties and functionality of these components, explicit reference is made to the explanations given above in the context of the first embodiment.

One difference with respect to the first embodiment lies in the design of the transverse beam 210. More precisely, with the transverse beam 210 the open profile cross section is generally L-shaped with a first shank 210.5 forming the first free end 210.1 and a second shank 210.6 forming the second free end 210.2. While, in the present example, the first and second shank 210.5, 210.6 are of substantially identical length, shanks of different length may also be envisaged with other variants. The first shank 210.5, in the transverse direction, continues into the web joint part 210.9 while the second shank 210.6, in the transverse direction, continues into the upper longitudinal flange section 108.5 of the longitudinal beam 208. This yields a particularly simple and easy to manufacture design.

Particularly suitable release of the torsional block by the web section 208.4 is achieved in that the second shank 210.6 has a shank length SL along the longitudinal axis and the aperture projection has a minimum shank distance $SD_{min}$ from a projection of the second shank 210.6 onto the web plane WP, wherein the minimum shank distance $SD_{min}$ is about 10% of the shank length SL. With other variants, the minimum shank distance $SD_{min}$ may be less than 20%, preferably less than 10%, more preferably less than 5%, of a the shank length SL. By this means only a comparatively small rib 208.7 (formed by the web section 208.4) is left counteracting the buckling deformation of the longitudinal beam 208 in this region.

It will be appreciated that the size of the aperture 212, in principle, again can be chosen as large as desired and possible. Limitations are only given by adjacent components, such as the transverse beam 210, but of course also by the required properties of the longitudinal beam 208, such as the bending rigidity of the longitudinal beam 208 about the transverse axis. With preferred, particularly useful designs the aperture projection area APA corresponds to 60% to 150%, preferably to 75% to 120%, more preferably to 85% to 110%, of the transverse beam projection area TBPA.

Similar applies to the overlap between the aperture projection area APA and the transverse beam projection area TBPA. In the present example, slightly about 45% of the aperture projection area APA overlap with the transverse beam projection area TBPA. It will be appreciated that, with other embodiments, another degree of overlap may be selected. In particular, with other preferred variants, at least 40%, preferably, at least 50%, more preferably 40% to 70%, of the aperture projection area APA overlap with the transverse beam TBP projection area TBPA. By this means a particularly beneficial release of the blocking effect of the web section is achieved.

As mentioned above, the reduction of the torsional rigidity TRT of the running gear frame 203 (or running gear frame unit 207, respectively) about the transverse axis can be essentially freely adjusted to the desired value by selecting the size and/or shape and/or location of the aperture 212 accordingly. In the present example, with the four apertures 212 at the junctions between the longitudinal beams 208 and the transverse beams 210, compared to an otherwise identical design without those apertures 112, an overall reduction of the torsional rigidity TRT by about 50% to 70% may be achieved. With other preferred variants, the aperture is arranged and configured such that a torsional rigidity TRT of the running gear frame unit 207 about the transverse axis is reduced by at least 10%, preferably at least 15%, more preferably at least 20%, compared to a reference running gear frame unit lacking the aperture 212 but being of otherwise identical configuration.

The degree of area overlap between the aperture projection area APA and the transverse beam projection area TBPA as noted above, typically, is a function of the shape of the transverse beam projection TBP. In the present example, the overlap is selected such that the aperture projection area APA overlaps the longest diagonals LD1, LD2 of the transverse beam projection area TBPA taken from the projection of the first free end 210.1 and of second free end 210.2, which here coincide with the projection CLP of the connecting line 210.4. Herewith, a particularly suitable release of the torsional block formed by the web section can be achieved.

Again, the projection of the connecting line CLP onto the web plane WP divides the aperture projection AP into a first aperture projection part APP1 and a second aperture projection part APP2, wherein the first aperture projection part APP1 is fully located within the transverse beam projection TBP. The arrangement is such that an area ratio between the first aperture projection part APP1 and the second aperture projection part APP2 it is about 45% by 55%, i.e. about 0.8. With other variants, this area ratio may preferably range from 0.6 to 1.5, preferably from 0.8 to 1.2, more preferably from 0.9 to 1.1. In many cases it is preferred that the area ratio is about 1.0. By these means, efficient release of the blocking effect of the web section 208.4 can be achieved.

A further difference to the first embodiment lies within the shape of the aperture 212. In the present example, the aperture 212 is a generally elliptic opening in the web section 208.4. The aperture projection area APA corresponds to about 80% of the transverse beam projection area TBPA. However, with other embodiments, the same outer contour as for the first embodiment may be chosen (as is indicated by contour 217), which then yields a higher reduction of the torsional rigidity TRT. Likewise, a polygonal outer contour may be chosen as is indicated by the contour 218.

Third Embodiment

Figure 8:
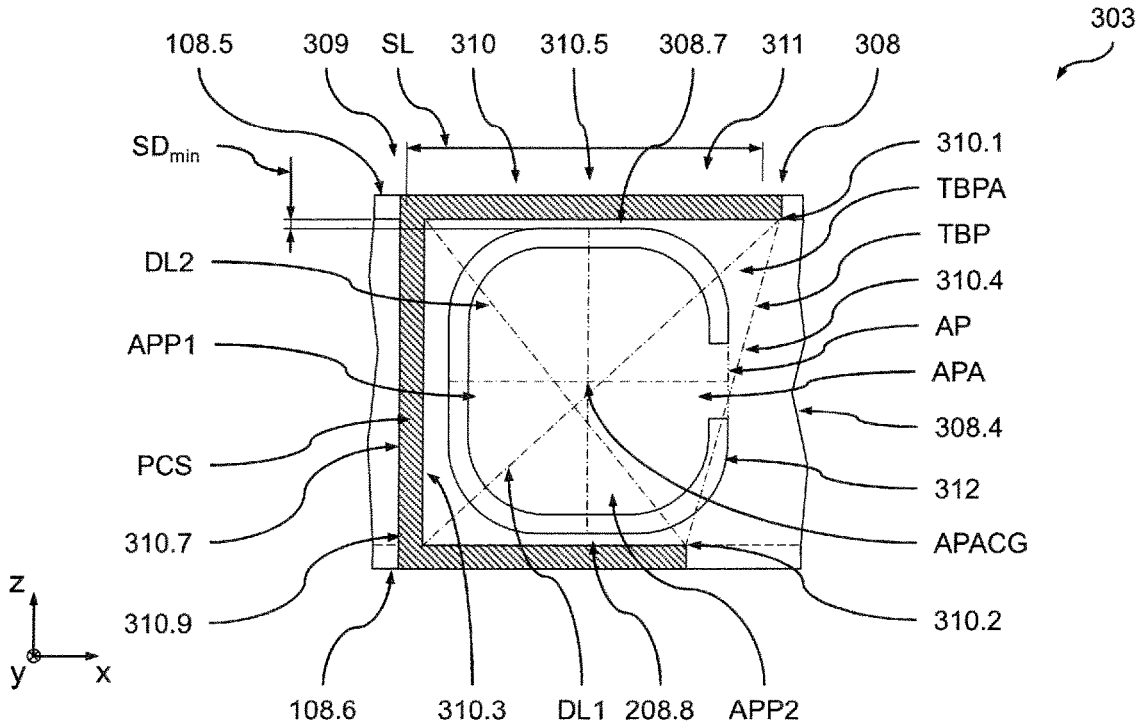
FIG. 8 is a sectional view of a detail of a further preferred embodiment of the running gear frame according to the invention in a view similar to FIG. 3.

In the following, a further preferred embodiment of the running gear frame 303 according to the invention will be described with reference to FIGS. 1, 2 and 8. The running gear frame 303 in its basic design and functionality corresponds to the running gear frame 103 of the first embodiment and may replace the running gear frame 103 in the rail vehicle of FIG. 1. While identical components are given the same reference, like components are given a reference increased by the value 200. Unless stated otherwise in the following, as regards the properties and functionality of these components, explicit reference is made to the explanations given above in the context of the first embodiment.

One difference with respect to the first embodiment lies in the design of the transverse beam 310. More precisely, the transverse beam 310 has another U-shaped design, wherein the first shank 310.5, in the transverse direction, continues into the upper longitudinal flange section 108.5 of the longitudinal beam 308, and the base 310.7, in the transverse direction, continues into the web joint part 310.9. In this case, the second shank 310.6, in the transverse direction, continues into the lower longitudinal flange section 108.6 of the longitudinal beam 308.

Particularly suitable release of the torsional block by the web section 308.4 is achieved in that the first shank 310.6 has a shank length SL along the longitudinal axis and the aperture projection has a minimum shank distance $SD_{min}$ from a projection of the first shank 310.6 onto the web plane WP, wherein the minimum shank distance $SD_{min}$ is about 2% to 5% of the shank length SL. With other variants, the minimum shank distance $SD_{min}$ may be less than 20%, preferably less than 10%, more preferably less than 5%, of a the shank length SL. By this means only a comparatively small rib 308.7 (formed by the web section 308.4) is left counteracting the buckling deformation of the longitudinal beam 308 in this region. A similarly small rib 308.8 is formed at the lower longitudinal flange section 108.6.

A further difference lies in the design of the aperture 312. As can be seen from FIG. 8, while confining essentially the same aperture projection AP and aperture projection area APA as in the first embodiment (see FIG. 4), the aperture 312 is only formed by a generally C-shaped slot in the web section 308.4. It will be appreciated that the width of the slot only has to be sufficiently large to allow the respective relative motion (between the walls confining the slot) necessary for the buckling deformation of the longitudinal beam 308. Otherwise, all the explanations given above in the context of the first embodiment apply here as well.

It will be appreciated that the size of the aperture 312, in principle, again can be chosen as large as desired and possible. Limitations are only given by adjacent components, such as the transverse beam 310, but of course also by the required properties of the longitudinal beam 308, such as the bending rigidity of the longitudinal beam 308 about the transverse axis. With preferred, particularly useful designs the aperture projection area APA corresponds to 60% to 150%, preferably to 75% to 120%, more preferably to 85% to 110%, of the transverse beam projection area TBPA.

Similar applies to the overlap between the aperture projection area APA and the transverse beam projection area TBPA. In the present example, about 95% of the aperture projection area APA overlap with the transverse beam projection area TBPA. It will be appreciated that, with other embodiments, another degree of overlap may be selected. In particular, with other preferred variants, at least 40%, preferably, at least 50%, more preferably 40% to 70%, of the aperture projection area APA overlap with the transverse beam TBP projection area TBPA. By this means a particularly beneficial release of the blocking effect of the web section is achieved.

As mentioned above, the reduction of the torsional rigidity TRT of the running gear frame 303 (or running gear frame unit 307, respectively) about the transverse axis can be essentially freely adjusted to the desired value by selecting the size and/or shape and/or location of the aperture 312 accordingly. In the present example, with the four apertures 312 at the junctions between the longitudinal beams 308 and the transverse beams 310, compared to an otherwise identical design without those apertures 112, an overall reduction of the torsional rigidity TRT by about 40% to 50% may be achieved. With other preferred variants, the aperture is arranged and configured such that a torsional rigidity TRT of the running gear frame unit 307 about the transverse axis is reduced by at least 10%, preferably at least 15%, more preferably at least 20%, compared to a reference running gear frame unit lacking the aperture 312 but being of otherwise identical configuration.

The degree of area overlap between the aperture projection area APA and the transverse beam projection area TBPA as noted above, typically, is a function of the shape of the transverse beam projection TBP. In the present example, the overlap is selected such that the aperture projection area APA overlaps the longest diagonals LD1, LD2 of the transverse beam projection area TBPA taken from the projection of the first free end 310.1 and of second free end 310.2, which here are separate from the projection CLP of the connecting line 310.4. Herewith, a particularly suitable release of the torsional block formed by the web section 308.4 can be achieved.

Here, the longest diagonal LD1 divides the aperture projection AP into a first aperture projection part APP1 and a second aperture projection part APP2, wherein the first aperture projection part APP1 is fully located within the transverse beam projection TBP. The arrangement is such that an area ratio between the first aperture projection part APP1 and the second aperture projection part APP2 it is about 55% by 45%, i.e. about 1.2. With other variants, this area ratio may preferably range from 0.6 to 1.5, preferably from 0.8 to 1.2, more preferably from 0.9 to 1.1. In many cases it is preferred that the area ratio is about 1.0. By these means, efficient release of the blocking effect of the web section 308.4 can be achieved.

While the present invention, in the foregoing has been exclusively described in the context of high speed rail vehicles, it will be appreciated that the invention can also be applied for any other rail vehicles, in particular, other rail vehicles operating at considerably lower nominal speeds.

The invention claimed is:

1. A running gear frame for a rail vehicle, wherein the rail vehicle has a nominal speed above 160 km/h, comprising:

a running gear frame unit comprising: (i) two longitudinal beams that extend along a longitudinal axis of the running gear frame unit and (ii) a transverse beam that extends along a transverse axis of the running gear frame unit, wherein a first of the two longitudinal beams comprises a longitudinal web section that extends in a web plane oriented perpendicular relative to the transverse axis, the transverse beam having a web joint part that is connected to the longitudinal web section to define a joint location, the transverse beam having a non-ring-shaped, open profile cross section adjacent to the joint location, the open profile cross section having a first free end and a second free end, and a connecting line between the first free end and the second free end that defines a transverse beam inner contour, wherein the longitudinal web section has an aperture located in a region of a transverse beam projection (TBP), the TBP being a projection of the transverse beam inner contour along the transverse axis onto the web plane, wherein the TBP defines a transverse beam projection area (TBPA); and wherein the aperture defines an aperture projection (AP), the AP being a projection of the aperture along the transverse axis onto the web plane, the AP having an outer contour that defines an aperture projection area (APA), the APA at least partially overlapping at least 60% of the TBPA.

2. The running gear frame of claim 1, wherein the APA corresponds to one of (i) at least 75% of the TBPA, or (ii) at least 85% of the TBPA.

3. The running gear frame of claim 1, wherein at least one of the following holds:

(i) the APA corresponds to between 60% and 150% of the TBPA;

(ii) at least 40% of the APA overlaps with the TBPA; or (iii) the aperture is arranged and configured such that a torsional rigidity of the running gear frame unit about the transverse axis is reduced by at least 10% compared to a reference running gear frame unit lacking the aperture but being of otherwise identical configuration.

4. The running gear frame of claim 1, wherein at least one of the following holds:

(i) an area center of gravity of the AP is located within the TBP;

(ii) an area center of gravity of the AP has a minimum distance from an outer contour of the TBP, the minimum distance being less than 20% of a maximum dimension of the AP; or (iii) and area center of gravity of the AP has a minimum distance from a projection of the connecting line onto the web plane, the minimum distance being less than 20% of a maximum distance of the AP.

5. The running gear frame of claim 1, wherein one of the following holds:

(i) a projection of the connecting line onto the web plane divides the AP into a first aperture projection part (AP1) and a second aperture projection part (AP2); or (ii) a longest diagonal of the TBP divides the AP into a first aperture projection part (AP1) and a second aperture projection part (AP2), the longest diagonal, in particular, extending through a projection of the one of the free ends.

6. The running gear frame of claim 1, wherein one of the following holds:

(i) a projection of the connecting line onto the web plane divides the AP into a first aperture projection part (AP1) and a second aperture projection (AP2); or (ii) a longest diagonal of the TBP divides the AP into a first aperture projection part (AP1) and a second aperture projection (AP2), the longest diagonal, in particular, extending through a projection of one of the free ends, wherein further at least one of the following holds:

wherein an area ratio between the AP1 and the AP2 ranges from 0.6 to 1.5; or the first aperture projection part (AP1) is fully located within the TBP.

7. The running gear frame of claim 1, wherein the open profile cross section is generally U-shaped with a first shank forming the first free end, a base and a second shank forming the second free end, the first and second shanks having different lengths, wherein one of the following holds:

(i) the first shank, in the transverse direction, continues into the web joint part, and the base, in the transverse direction, continues into a longitudinal flange section of the longitudinal beam, wherein the second shank, in the transverse direction continues into a further web joint part, wherein a part of the AP corresponding to the base has a base length along the longitudinal axis and the AP has a minimum base distance from a projection of the base onto the web plane, wherein the minimum base distance is less than 20% of a the base length, (ii) the first shank, in the transverse direction, continues into a longitudinal flange section of the longitudinal beam, and the base, in the transverse direction, continues into the web joint part, wherein the second shank, in the transverse direction continues into a further longitudinal flange section of the longitudinal beam. wherein at least one of the shanks has a shank length along the longitudinal axis and the AP has a minimum shank distance from a projection of the at least one shank onto the web plane, wherein the minimum shank distance is less than 20% of the shank length.

8. The running gear frame of claim 1, wherein at least one of the following holds:

(i) the AP has an outer contour which is at least one of section-wise curved and at least section-wise polygonal; or (ii) the aperature, in the web plane, has an outer contour which is generally elliptic.

9. The running gear frame of claim 1, wherein a first of the longitudinal beams, at least in the region of the joint location, has at least one longitudinal flange section connected to the longitudinal web section, wherein at least one of the following holds:

(i) the longitudinal flange section extends in a plane substantially perpendicular to the web plane;

(ii) the longitudinal flange section is an upper flange section of the longitudinal beam; or (iii) the longitudinal beam, at least in the region of the joint location, has a further longitudinal flange section connected to the longitudinal web section, wherein the further longitudinal flange section mainly extends in a plane substantially perpendicular to the web plane, the longitudinal beam, in a plane perpendicular to the longitudinal axis having a generally h-shaped or a generally H-shaped cross-section in the region of the joint location.

10. The running gear frame of claim 1, wherein at least one of the following holds:

(i) the longitudinal web section has at least one further aperture located adjacent to the aperture;

(ii) the longitudinal web section, in the longitudinal direction, has a further aperture located on each side of the aperture; or (iii) the longitudinal web section has a plurality of apertures arranged in a sequence of aperatures along longitudinal direction, the plurality of apertures including the aperture and at least two further apertures.

11. The running gear frame of claim 1, wherein a first of the longitudinal beams has one or more transverse web sections, each transverse web section located adjacent to the aperture and extending in a transverse web plane perpendicular to the longitudinal axis, wherein at least one of the following holds:

(i) the transverse web section, along the transverse axis, extends up to the region of a lateral end of at least one longitudinal flange section of the longitudinal beam;

(ii) the transverse web section, along the transverse axis, substantially continues the web joint part; or (iii) two transverse web sections, each located adjacent to the aperture, and at least one longitudinal flange section of the longitudinal beam form a lateral reinforcement cell of the longitudinal beam.

12. The running gear frame of claim 1, wherein the transverse beam is a first transverse beam, wherein the joint location is a first joint location, and wherein the running gear frame unit comprises a second transverse beam substantially rigidly connected to a first of the longitudinal beams in the region of a second joint location, wherein at least one of the following holds:

(i) in the region of the second joint location, a configuration of the second transverse beam is substantially identical to a configuration of the first transverse beam in the region of the first joint location;

(ii) in the region of the second joint location, a configuration of the longitudinal beam is substantially identical to a configuration of the longitudinal beam in the region of the first joint location; or (iii) the first transverse beam and the second transverse beam are substantially rigidly connected via at least one transverse beam connector part extending along the longitudinal axis and spaced apart, along the transverse axis, from the longitudinal beams.

13. The running gear frame of claim 1, wherein a height axis, a center longitudinal plane, and a center transverse plane extend through a center point of the running gear frame unit, the center longitudinal plane being perpendicular to the transverse axis, the center transverse plane being perpendicular to the longitudinal axis, wherein at least one of the following holds:

(i) at least the longitudinal beams are substantially symmetric with respect to the center longitudinal plane;

(ii) at least the longitudinal beams, in planes perpendicular to the height axis, are substantially symmetric with respect to the height axis;

(iii) at least one of the longitudinal beams is substantially symmetric with respect to the center transverse plane;

(iv) at least the transverse beam is substantially symmetric with respect to the center longitudinal plane; or (v) two transverse beams are provided and at least the two transverse beams are substantially symmetric with respect to the center transverse plane.

14. The running gear frame of claim 1, wherein a first of the longitudinal beams and the transverse beam, at least in the region of the joint location, are formed by a monolithically cast component made of a grey cast iron material, wherein at least one of the following holds:

(i) the monolithically cast component substantially entirely forms the longitudinal beams and the transverse beam; or (ii) the grey cast iron material is a spheroidal graphite iron (SGI) cast material, the spheroidal graphite iron cast material, in particular, being one of EN-GJS-450-18, EN-GJS-500-10, EN-GJS-600-10, EN GJS 400 18U LT and EN-GJS-350-22-LT.

15. A running gear for a rail vehicle, comprising the running gear frame of claim 1, wherein at least one of the following holds:

(i) the running gear frame, in a region of free ends of the longitudinal beams, is supported on two-wheel units; or (ii) the running gear frame is a running gear frame for a Jacobs-type bogie.

16. The rail vehicle of claim 15, wherein the running gear supports two wagon bodies in a Jacobs-type bogie.

17. The running gear frame of claim 1, wherein the open profile cross section is generally L-shaped with a first shank forming the first free end and a second shank forming the second free end.

18. The running gear frame of claim 1, wherein the open profile cross section is generally L-shaped with a first shank forming the first free end and a second shank forming the second free end, the first shank, in the transverse direction, continuing into the web joint part, and the second shank, in the transverse direction, continuing into a longitudinal flange section of a first of the longitudinal beams, wherein the second shank has a shank length along the longitudinal axis and the AP has a minimum shank distance from a projection of the second shank onto the web plane, the minimum shank distance being less than 20% of a the shank length.

19. The running gear frame of claim 1, wherein the open profile cross section is generally U-shaped with a first shank forming the first free end, a base and a second shank forming the second free end.

20. A method for manufacturing a running gear frame for a rail vehicle a rail vehicle having a nominal speed above 160 km/h, the running gear frame comprising a running gear frame unit defining a longitudinal axis, a transverse axis, and a height axis, the running gear frame comprising two longitudinal beams and at least one transverse beam, each of the longitudinal beams extending along the longitudinal axis of the running gear frame unit, and the at least one transverse beam extending along the transverse axis of the running gear frame unit, the method comprising:

connecting the at least one transverse beam to at least one of the longitudinal beams in an area of a joint location;

positioning a longitudinal web section of the at least one of the longitudinal beams, at least in a region of the joint location, in a web plane that is oriented perpendicular relative to the transverse axis, a web joint part of the at least one transverse beam being connected to the longitudinal web section; and positioning an open structure element of the at least one transverse beam, at least in the region of the joint location, in a sectional plane that is oriented perpendicular relative to the transverse axis, the at least one transverse beam having an open, non-ring-shaped profile cross section;

wherein the open profile cross section has a first free end and a second free end, wherein a transverse beam inner contour is defined by a connecting line between the first free end and the second free end and an inner circumference of the profile cross section between the first free end and the second free end, the longitudinal web section being provided with an aperture located in the region of a transverse beam projection (TBP), wherein the TBP is a projection of the transverse beam inner contour along the transverse axis onto the web plane, the TBP confining a transverse beam projection area (TBPA), the aperture defining an aperture projection (AP) that is a projection of the aperture along the transverse axis onto the web plane, wherein an outer contour of the AP defines an aperture projection area (APA), wherein the APA at least partially overlaps the TBPA and the APA at least partially overlaps at least 60% of the TBPA.

* * * * *